US010930463B2

(12) United States Patent
Schlaak

(10) Patent No.: US 10,930,463 B2
(45) Date of Patent: Feb. 23, 2021

(54) VENTILATED FUSE HOUSING

(71) Applicant: Littelfuse, Inc., Chicago, IL (US)

(72) Inventor: Michael Schlaak, Morton Grove, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 16/403,520

(22) Filed: May 4, 2019

(65) Prior Publication Data

US 2019/0259556 A1 Aug. 22, 2019

Related U.S. Application Data

(62) Division of application No. 15/351,872, filed on Nov. 15, 2016, now Pat. No. 10,325,746.

(51) Int. Cl.

| | |
|---|---|
| ***H01H 69/02*** | (2006.01) |
| ***H01H 85/165*** | (2006.01) |
| ***H01H 85/00*** | (2006.01) |
| ***H01H 85/43*** | (2006.01) |
| ***H01H 85/055*** | (2006.01) |
| *H01H 85/045* | (2006.01) |
| *H01H 85/175* | (2006.01) |

(52) U.S. Cl.

CPC ..... *H01H 85/165* (2013.01); *H01H 85/0082* (2013.01); *H01H 85/055* (2013.01); *H01H 85/43* (2013.01); *H01H 69/02* (2013.01); *H01H 85/0452* (2013.01); *H01H 85/175* (2013.01); *H01H 2223/002* (2013.01); *Y10T 29/49107* (2015.01)

(58) Field of Classification Search

CPC ..... H01H 85/143; H01H 85/43; H01H 2223/002; H01H 69/02; H01H 71/122; H01H 85/055; H01H 85/165; H01H 85/08; H01H 85/003; A62C 2/242; Y10T 137/1797; Y10T 29/49107

USPC ..... 29/623, 428, 622, 825, 876, 878

See application file for complete search history.

(56) References Cited

U.S. PATENT DOCUMENTS

| | | | | |
|---|---|---|---|---|
| 2,592,399 | A | 4/1952 | Edsall | |
| 3,781,746 | A * | 12/1973 | Cuzzone | H01H 85/20 337/204 |
| 4,344,060 | A | 8/1982 | Ciesemier et al. | |
| 4,563,666 | A | 1/1986 | Borzoni | |
| 4,661,793 | A | 4/1987 | Borzoni | |
| 5,179,436 | A | 1/1993 | Asdollahi et al. | |
| 5,287,079 | A | 2/1994 | Bernardi et al. | |

(Continued)

FOREIGN PATENT DOCUMENTS

| | | |
|---|---|---|
| BE | 0895700 | 5/1983 |
| CN | 203165839 U | 8/2013 |

(Continued)

*Primary Examiner* — Thiem D Phan

(74) *Attorney, Agent, or Firm* — Kacvinsky Daisak Bluni PLLC

(57) ABSTRACT

A fuse including a first housing part and a second housing part that are joined together to define a cavity, a fuse element disposed within the cavity, a first terminal extending from a first end of the fuse element and out of the housing, and a second terminal extending from a second end of the fuse element and out of the housing, the housing having a vent channel extending from an outer surface of the housing to the cavity for allowing vapor to escape from the cavity.

6 Claims, 8 Drawing Sheets

(56) References Cited

U.S. PATENT DOCUMENTS

| | | | | |
|---|---|---|---|---|
| 5,426,411 | A | 6/1995 | Pimpis et al. | |
| 5,793,275 | A | 8/1998 | Iversen | |
| 6,054,915 | A * | 4/2000 | Rowton ..... | H01H 85/2045 337/180 |
| 6,542,063 | B2 | 4/2003 | Kawashima et al. | |
| 6,762,670 | B1 | 7/2004 | Yen | |
| 7,539,001 | B2 | 5/2009 | Takeyoshi | |
| 9,184,011 | B2 | 11/2015 | Jung et al. | |
| 9,607,799 | B2 | 3/2017 | Schmidt et al. | |
| 2016/0141140 | A1 | 5/2016 | Schmidt et al. | |

FOREIGN PATENT DOCUMENTS

| | | | |
|---|---|---|---|
| CN | 204537973 | U | 8/2015 |
| DE | 202014100638 | U1 | 6/2015 |
| JP | 5675859 | B2 | 2/2015 |

* cited by examiner

VENTILATED FUSE HOUSING

CROSS-REFERENCE TO RELATED APPLICATIONS

This application is a Divisional application of pending U.S. patent application Ser. No. 15/351,872, filed Nov. 15, 2016, the entirety of which application is incorporated by reference herein.

FIELD OF THE DISCLOSURE

Embodiments of the present disclosure relate generally to the field of fuses, and more particularly to a ventilated fuse housing.

BACKGROUND OF THE DISCLOSURE

Fuses are commonly used as circuit protection devices. A fuse can provide electrical connections between sources of electrical power and circuit components to be protected. One type of fuse, commonly referred to as a "bolt down" or "strip" fuse, includes a fusible element disposed within a hollow fuse body. Planar conductive terminals may extend from opposite ends of the fusible element and may protrude from the fuse body to provide a means of connecting the fuse between a source of power and a circuit component that is to be protected.

Bolt down fuses are commonly used in automotive applications where higher voltage ratings are necessary. Upon an occurrence of a specified fault condition in a circuit, such as an overcurrent condition, the fusible element of a bolt down fuse may melt or otherwise separate to interrupt current flow in the circuit path. Portions of the circuit are thereby electrically isolated and damage to such portions may be prevented or at least mitigated.

When a fuse element melts, the fuse element material quickly vaporizes during the arcing portion of the fuse opening, and a high amount of energy is quickly released, building high pressure inside the fuse body. This amount of energy release, and the pressure generated, increases as the circuit voltage is increased. If the pressure is not sufficiently relieved, the fuse body may rupture which is an unacceptable condition in most industry standards for fuse performance. A fuse housing design must be strong enough to withstand high pressure during element arcing, but still allow the pressure to safely dissipate without rupturing. The manufacturing technique of ultrasonic welding housing pieces together is efficient, low cost, and enables a very strong finished housing that is capable of withstanding relatively high internal pressures. However, this technique may effectively seal the interior of a fuse body and prevent gas from escaping therefrom, increasing the likelihood of rupture in the event of a fault condition.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of the present invention is a fuse comprising a housing including a first housing part and a second housing part that are joined together to define a cavity. A fuse element is disposed within the cavity. A first terminal extending from a first end of the fuse element and out of the housing, and a second terminal extending from a second end of the fuse element and out of the housing. The housing has a vent channel extending from an outer surface of the housing to the cavity for allowing vapor to escape from the cavity.

An exemplary embodiment of the present invention is a fuse housing comprising a first housing part and a second housing part that are joined together to define a cavity. A vent channel extending from an outer surface of the housing to the cavity for allowing vapor to escape from the cavity.

An exemplary method for forming a fuse according to the present invention comprises joining a first housing part to a second housing part to form a housing that defines a cavity, and providing the housing with a vent channel extending from an outer surface of the housing to the cavity for allowing vapor to escape from the cavity.

BRIEF DESCRIPTION OF THE DRAWINGS

By way of example, specific embodiments of the disclosed device will now be described, with reference to the accompanying drawings, in which.

DETAILED DESCRIPTION

Figure 1:
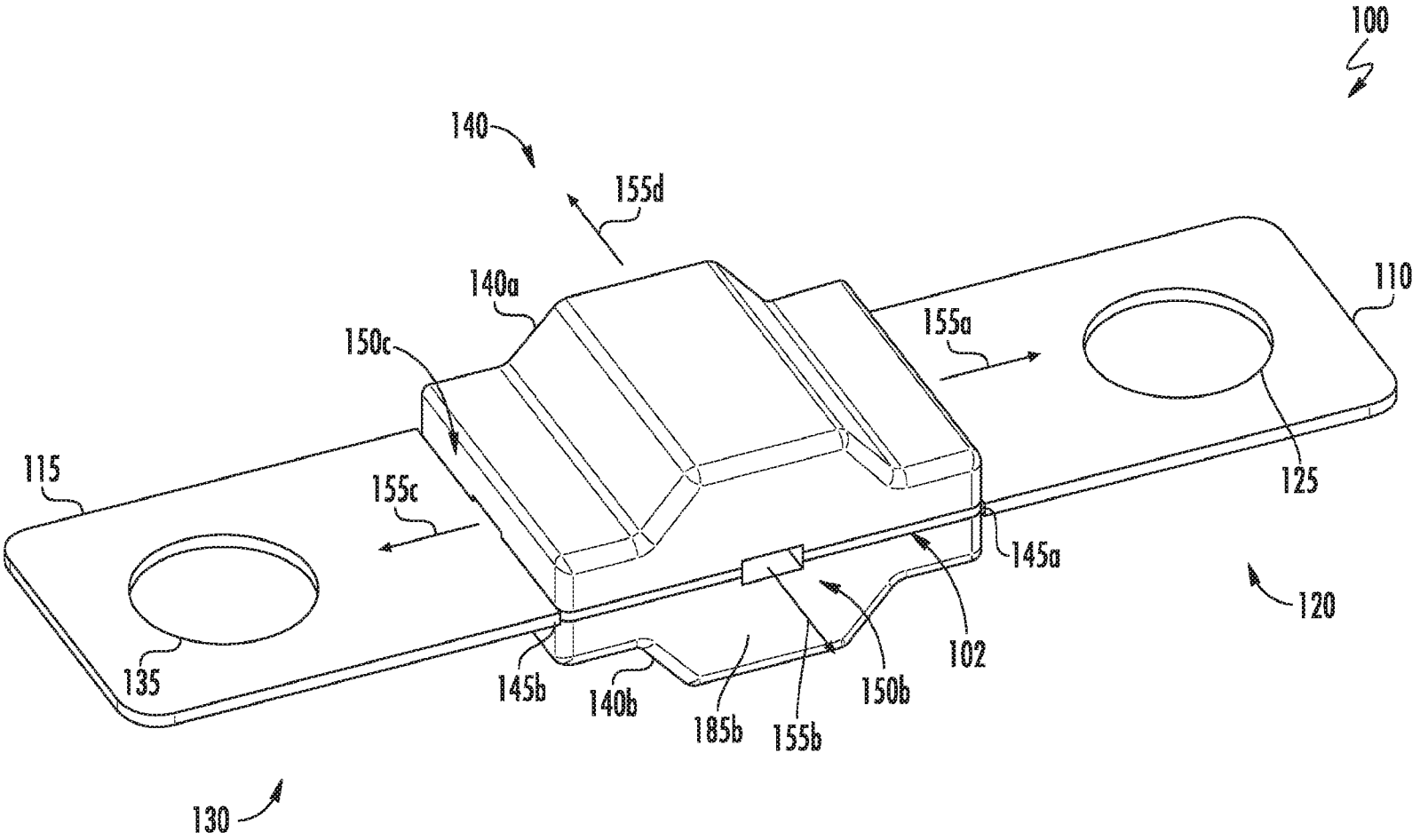
FIG. 1 is a perspective view illustrating an exemplary embodiment of a fuse in accordance with the present disclosure.

A fuse in accordance with the present disclosure will now be described more fully hereinafter with reference to the accompanying drawings, in which certain exemplary embodiments of the fuse are presented. The fuse may be embodied in many different forms and is not to be construed as being limited to the embodiments set forth herein. These embodiments are provided so that this disclosure will be thorough and complete, and will fully convey the scope of the fuse to those skilled in the art. In the drawings, like numbers refer to like elements throughout unless otherwise noted.

Figure 2:
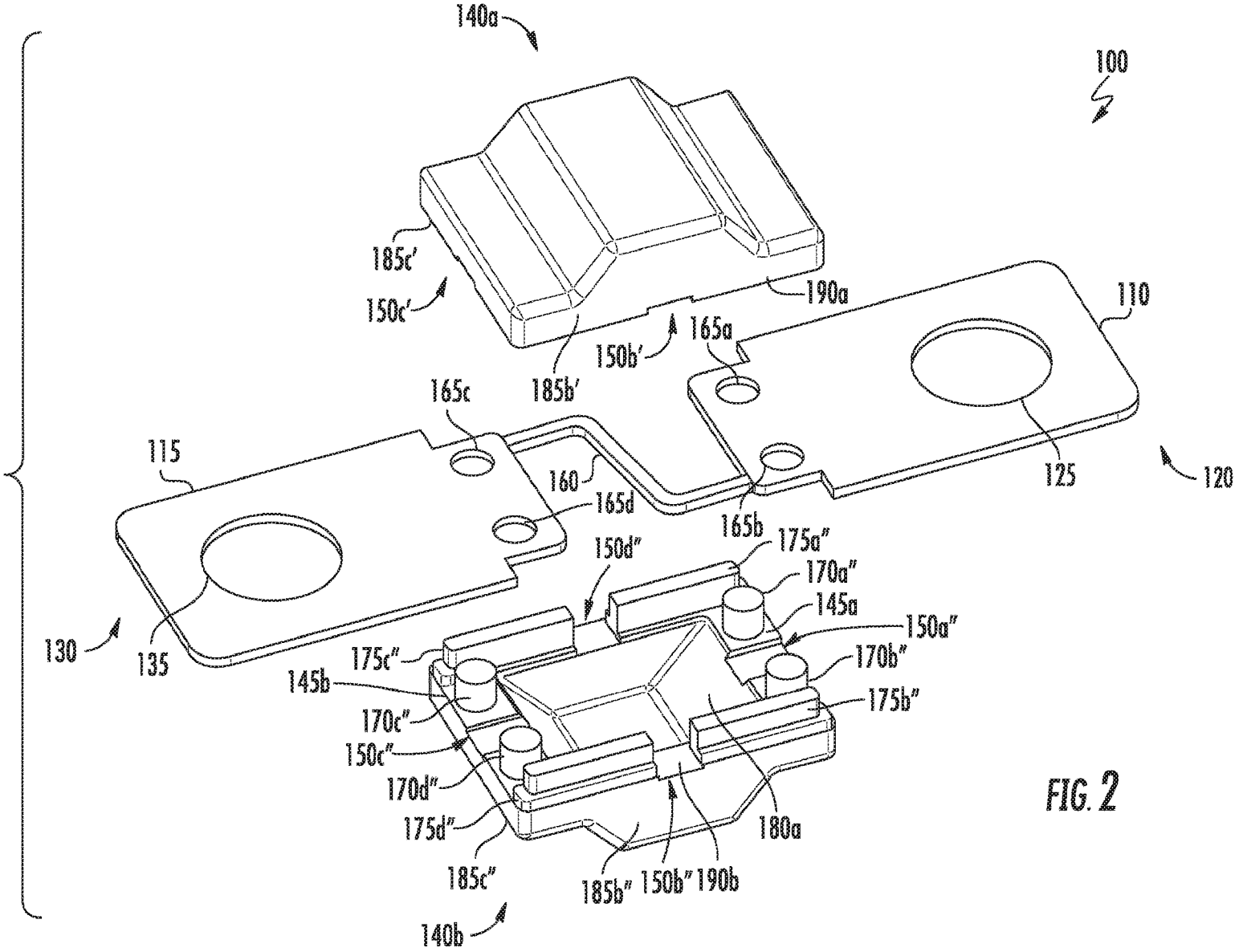
FIG. 2 is an exploded perspective view of the fuse illustrated in FIG. 1.

FIGS. 1 and 2 show an assembled perspective view and an exploded perspective view, respectively, of a fuse 100 in accordance with an exemplary embodiment of the present disclosure. The fuse 100 includes terminals 110, 115, a fuse element 160, and a housing 140. Other materials may be added to the fuse element or the internal fuse cavity to influence the behavior of the fuse. This could include (but is not limited to) solder attached to the fuse element, silicone (or similar materials) molded onto the fuse element, or inserts placed inside the fuse cavity (made from solid or porous material such as silicone or silicone foam). Terminals 110, 115 may be made from a variety of conductive materials including, but not limited to, copper, tin, silver, zinc, aluminum, alloys including such materials, or combinations thereof. The terminals may be positioned at ends of the fuse 100, for example, with a first terminal 110 disposed at a first end 120 and a second terminal 115 disposed at a second end 130. The terminals 110, 115 extend through the housing 140 via clearances 145*a*, 145*b*, and are electrically connected to a fuse element 160. For example, the first terminal 110 extends through clearance 145*a* of the housing 140, and the second terminal 115 extends through clearance 145*b* of the housing 140.

In some embodiments, the terminals 110, 115 may have respective connection holes 125, 135. For example, the connection hole 125 is disposed at the first end 120, and the connection hole 135 is disposed at the second end 130. The connection holes 125, 135 may be configured to physically and electrically connect the fuse 100 to a source of power and a circuit component. For example, the holes 125, 135 may be configured to receive a bolt or post. The holes 125, 135 may be circular, for example, to receive a standard bolt or post. However, the holes 125, 135 may be configured in any shape to receive any shape bolt, post, or other retaining/connecting structure.

The terminals 110, 115 are configured to electrically connect the fuse to a source of power (not shown) and a circuit component to be protected (not shown). The fuse element 160, described in detail below, bridges and electrically connects the terminals 110, 115. In some embodiments, the fuse element 160 may be made from the same conductive material as the terminals 110, 115 as described above, including for example, copper, tin, silver, zinc, aluminum. In other embodiments, the terminals 110, 115 may be made from a different material than fuse element 160. The fuse element 160 may be any known configuration for providing a circuit interrupt, including but not limited to a wire, a metal link, and an element shaped into multiple bends and/or curves. Various techniques are known for forming the terminals 110, 115 and the fuse element 160 together, including, but not limited to, stamping, cutting, and printing, and can include forming the fuse element 160 and the terminals 110, 115 separately or as one piece. If the fuse element 160 and the terminals 110, 115 are formed separately (i.e., in separate pieces), the pieces may subsequently be joined together using various techniques, including, for example, soldering, welding, and other known joining processes.

The housing 140 may be made from a variety of materials, including plastic, composite, epoxy, or the like. In some examples, the housing 140 may be formed around the fuse element 160. In some embodiments, the housing 140 may be a multi-part structure, and the fuse 100 can be assembled by connecting separate upper and lower housing parts 140*a*, 140*b* together around the fuse element 160, thereby positioning the fuse element 160 in a cavity 180 of the assembled housing 140. The cavity 180 may be a hollow space in the housing 140, such that cavity portions 180*a*, 180*b* are included in the upper and lower housing parts 140*a*, 140*b*, respectively. The housing 140 may be configured to support the fuse element 160 within the cavity 180 as described in detail below.

In some embodiments, the housing 140 may include a plurality of segments or parts that are joined together to define the cavity 180. For example, the housing 140 may include upper and lower housing parts 140*a*, 140*b* that may be joined together via an ultrasonic weld seam to form a contiguous, substantially sealed body as further described below. It is envisioned that other welding or joining techniques may be used to join the housing parts upper and lower 140*a*, 140*b* together to create sealed juncture therebetween. Joining the upper and lower housing parts 140*a*, 140*b* together via ultrasonic welding facilitates expedient manufacturing of the housing 140 and provides a stronger juncture between the upper and lower housing parts 140*a*, 140*b* relative to other known assembly techniques (e.g., heat staking, riveting, etc.), and is more cost effective than such techniques.

During normal operation of the fuse 100, current flows from terminal 110 to terminal 115 through the fuse element 160 (or vice versa). During an abnormal condition (i.e., an overcurrent condition), the fuse element 160 may melt and separate, and an electrical arc may propagate between the separated ends of the fuse element 160. The electrical arc may vaporize portions of the fuse element 160, thus producing vapor that may significantly increase pressure within the housing 140. As described above, this increase in pressure may be particularly significant in high-voltage, automotive fuses in which a fuse element is rapidly vaporized. If the pressure within the housing 140 is not alleviated, it may cause the fuse 100 to rupture, which may result in damage to surrounding circuit elements. Thus, the housing 140 may be provided with vent channels 150*a-d* extending from the cavity 180 to one or more outer surfaces of the housing 140. Vaporized material and gas may escape the housing 140 by way of the vent channels 150*a-d*, thereby mitigating pressure buildup within the housing and reducing the likelihood of rupture during a fault condition. Specifically, vaporized material and gas may vent out of the housing 140 in the direction of arrows 155*a-d* shown in FIG. 1.

While the fuse 100 is depicted as having four vent channels 150*a-d* disposed on adjacent sides of the housing 140, it is contemplated that the number, configuration, orientation, and sizes of the vent channels 150*a-d* may be varied without departing from the present disclosure. For example, the fuse 100 may alternatively be implemented with only two vent channels disposed on opposing sides of the housing 140 (e.g., with only vent channels 150*a*, 150*c* or with only vent channels 150*b*, 150*d*). The number, configuration, orientation, and sizes of the vent channels 150*a-d* may depend on various factors, including the voltage rating of the fuse 100, the size of the cavity 180, the environment in which the fuse 100 will be implemented, and manufacturing costs and processing times. The vents may be specifically oriented to minimize the impact of venting on adjacent or nearby components. For example, the vents may be designed to disperse the element vapor away from the fuse connection points, preventing the vapor from contaminating any reusable electrical terminals or wires.

One or more of the vent channels 150*a-d* may be defined by cavities or apertures formed in adjacent, abutting portions of the upper and lower housing parts 140*a*, 140*b*. For example, the vent channel 150*a* may be defined by an upper vent channel portion 150*a*' formed in the upper housing part 140*a* and a lower vent channel portion 150*a*" formed in the lower housing part 140*b*. When the housing 140 is assembled as shown in FIG. 1, the upper vent channel portion 150*a*' and lower vent channel portion 150*a*" may align with one another to form the vent channel 150*a*. One or more of the vent channels 150*b*, 150*c*, 150*d* may additionally or alternatively be similarly defined by upper vent channel portions and lower vent channel portions formed in the housing parts 140*a*, 140*b*. Although all sides and surfaces of the fuse 100 are not visible in the figures, it is generally understood that the views not shown are symmetrical and/or complementary such that the fuse components are sufficiently understood by the displayed figures. As shown in FIGS. 1 and 2, the vent channels 150*a*, 150*c* at the opposing longitudinal ends of the housing 140, which are defined by upper vent channels portions 150*a*', 150*c*' and lower vent channel portions 150*a*", 150*c*", respectively, may be bisected by the terminals 110, 115 extending upper housing part 140*a* and the lower housing part 140*b*.

The upper vent channel portions 150*a*'-d' may be formed in a mating surface 190*a* of the upper housing part 140*a*, and the lower vent channel portions 150*a*"-d" may be formed in a mating surface 190*b* of the lower housing part 140*b*. The upper and lower vent channel portions 150*a*'-d', 150*a*"-d" may extend from a respective surfaces 185*a*'-d', 185*a*"-d" to the cavity 180, thereby providing pathways for vapor to escape from the cavity 180. The upper vent channel portions 150*a*'-d' and lower vent channel portions 150*a*"-d" may be equal in length, width, and depth, so that the fuse 100 is generally symmetrical when the housing 140 is assembled, though this is not critical.

In some embodiments, the vent channel portions 150*a*'-d', 150*a*"-d" may include angled, curved, or otherwise tortuous and/or non-linear portions for allowing gaseous vapor to escape from the housing 140 while preventing debris and external contaminants from entering the housing 140. In other embodiments, one or more barriers may be formed in the vent channels 150*a-d*. For example, FIGS. 2B-2C show an embodiment of the vent channel portions 150*a*'-d, 150*a*"-d" including a barrier. In some embodiments, the vent channel portion 150*a*"-d" may include a wall portion 205*a*-205*d*. The wall portion 205*a*-205*d* may be a thin wall formed at an end of the vent channel 150*a-d* towards the surface 185*a*"-d", and integral to the housing 140. The wall portion 205*a-d* may extend from one or both of the upper housing part 140*a* at vent channel portions 150*a*'-d' and the lower housing part 140*b* at vent channel portions 150*a*"-d". The wall portion 205*a-d* provides a barrier to prevent debris and contaminants from migrating into the fuse via the vent channels 150*a-d*. The thickness of the wall portion 205*a*-205*d* may be understood to be thick enough to be molded into the housing 140, but thin enough to rupture during an overload or short circuit condition so that the vent channels are allowed to vent the vaporized material and gases, thereby preventing rupture. For example, the wall portion 205*a-d* may be thinner than surrounding portions of the housing 140.

Figure 2A:
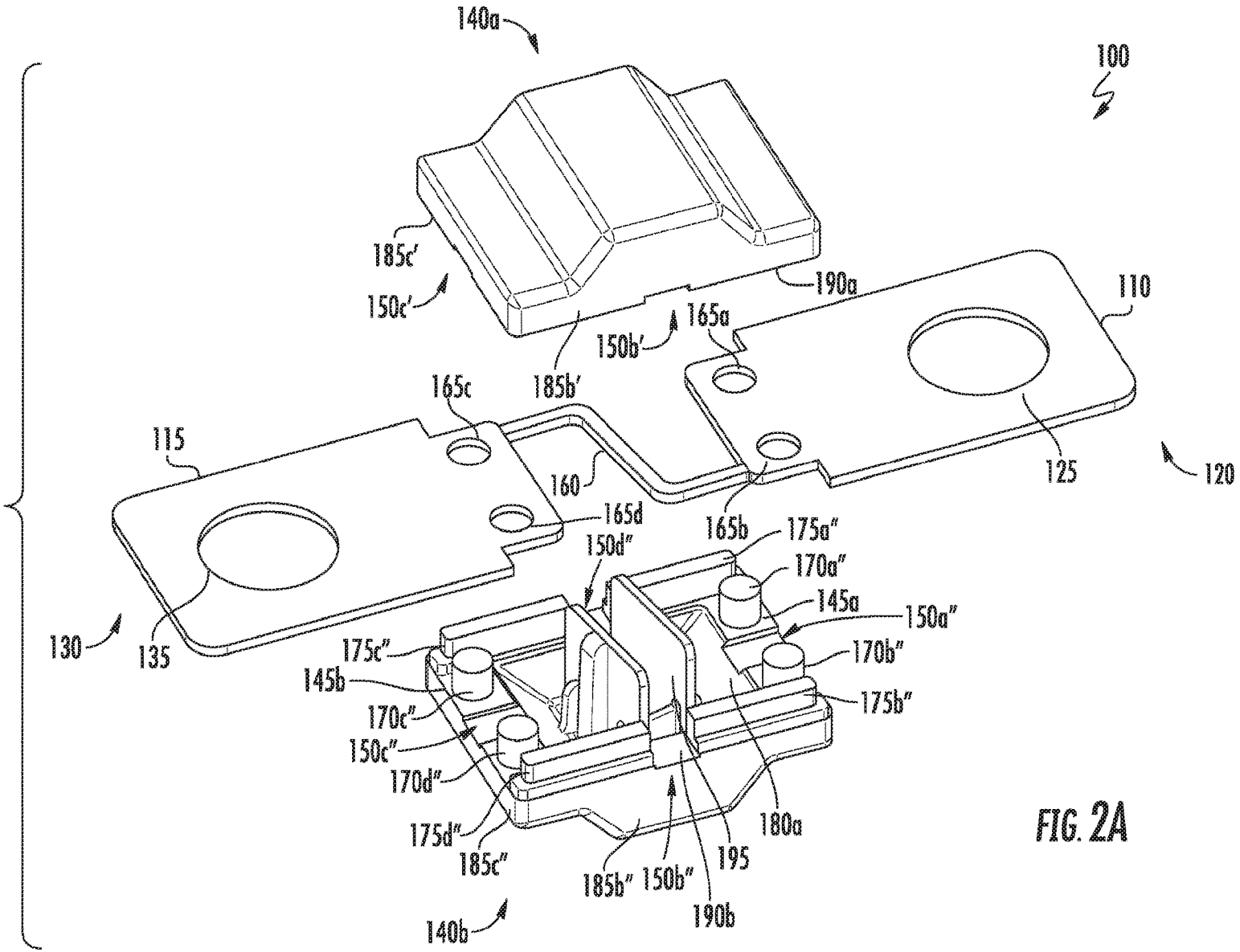
FIG. 2A is an exploded perspective view illustrating another exemplary embodiment of a fuse in accordance with the present disclosure.
Figure 2B:
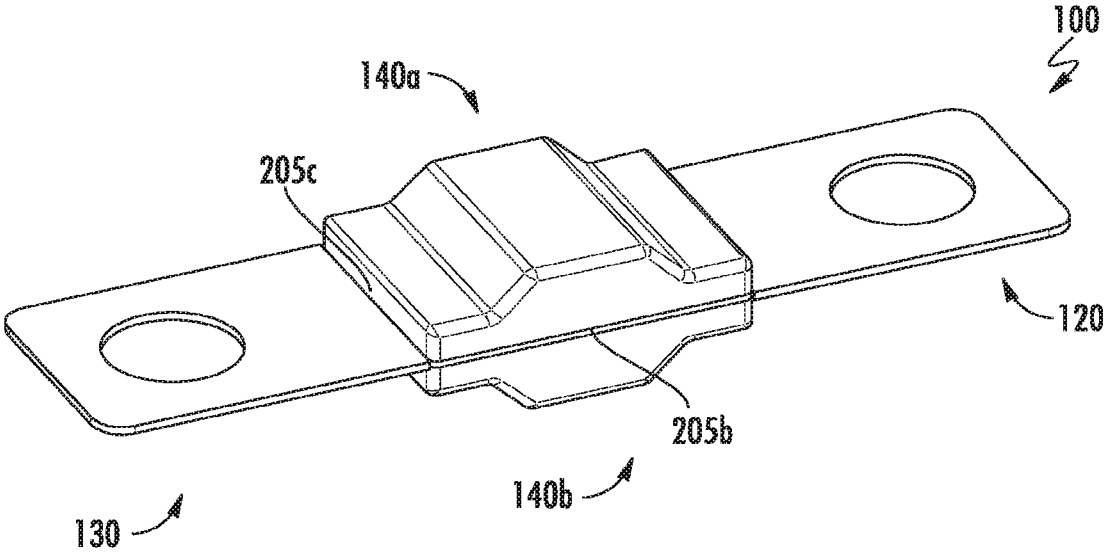
FIGS. 2B-D are perspective views illustrating exemplary vent channels of a fuse according to embodiments of the present disclosure.
Figure 2C:
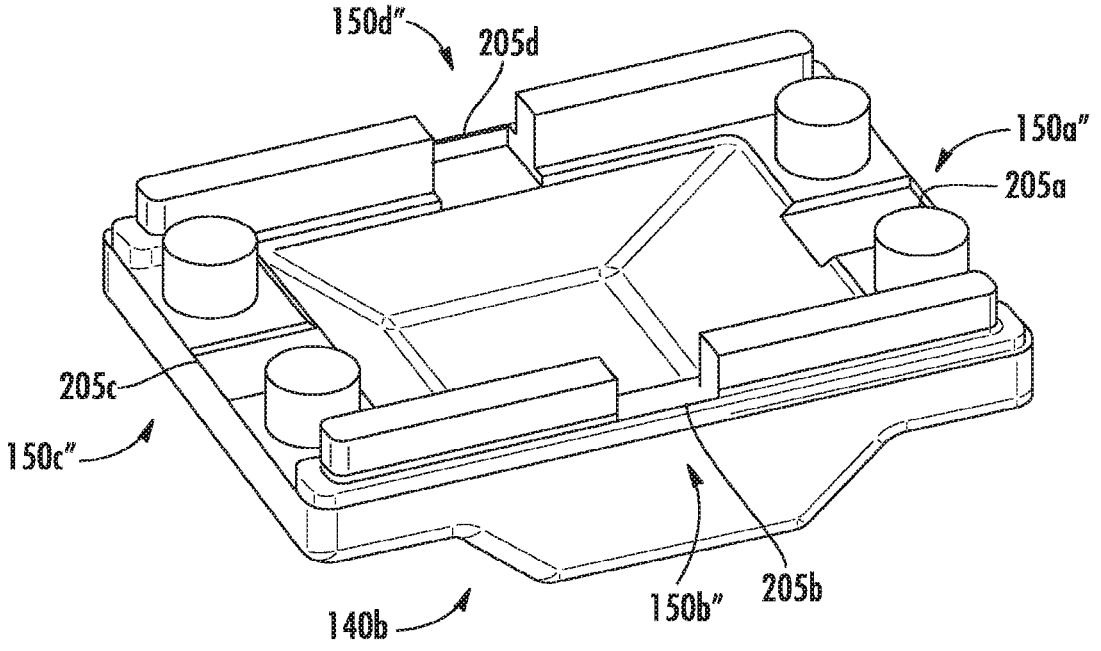
Figure 2D:
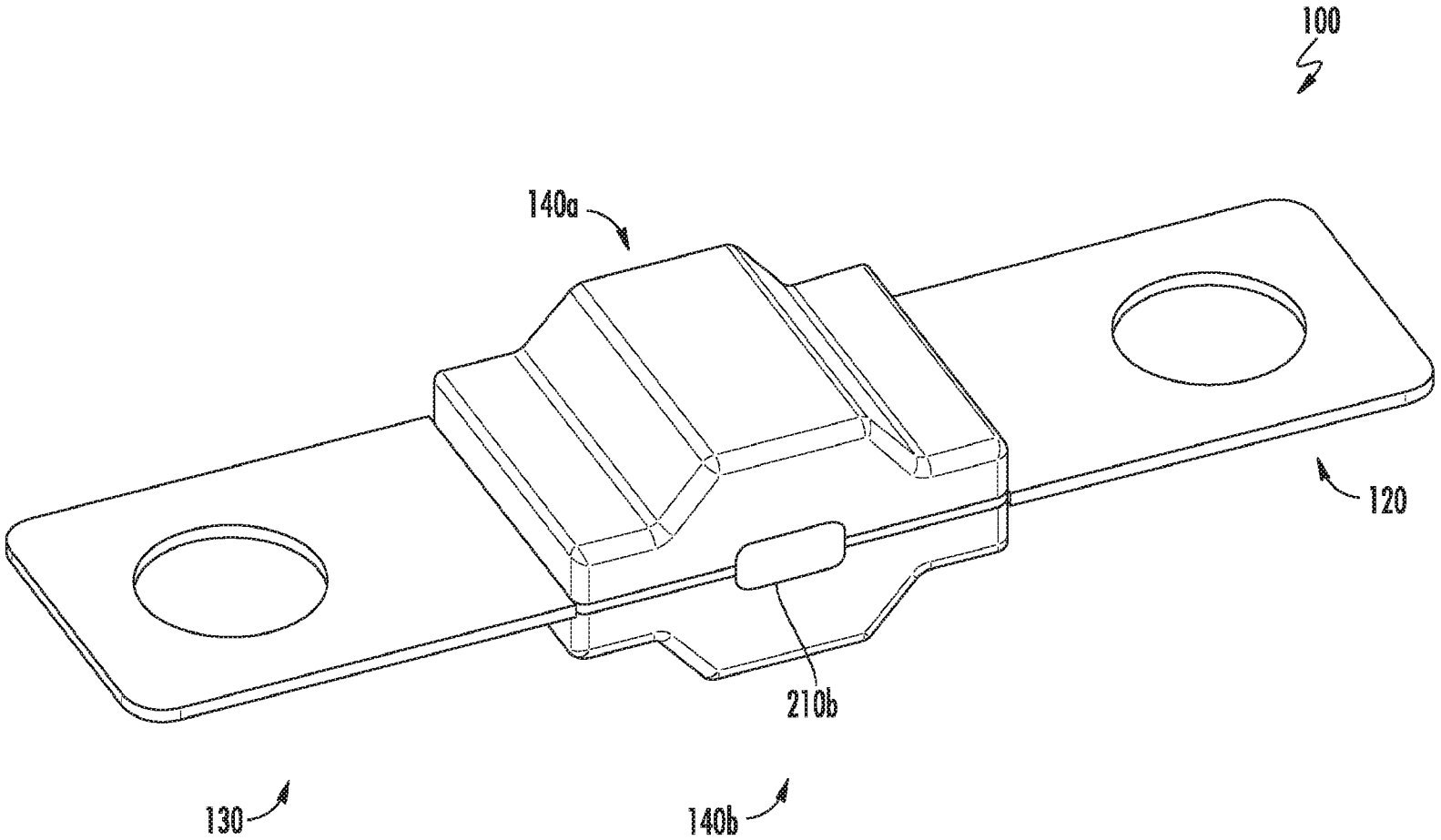

In another embodiment, shown in FIG. 2D, an outer barrier 210*a-d* may be disposed on the surface 185*a-d* of the housing 140*a-d* for covering the vent channel. The outer barrier 210*a-d* may be attachable to the vent channel 150*a-d* at the surface 185*a-d* by known joining mechanisms, including but not limited to pins, hinges, dowels, adhesives, and the like. The outer barrier 210*a-d* may cover the respective vent channel 150*a-d* for preventing ingress of external contaminants into the cavity. During an overload or short circuit condition the outer barriers 210*a-d* may at least partially detach from the vent channels 150*a-d* to allow the vaporized material and gases to vent out of the fuse 100.

In embodiments, the vent channels 150*a-d* may be formed in portions of the housing 140 that are unlikely to be exposed to debris and environmental contaminants during use. Particularly, since fuses of the type disclosed herein are utilized in automotive and otherwise industrial environments, oil, lubricants, and dirt are typically present. The vent channels 150*a-d* may be formed in portions of the housing 140 such that when the fuse 100 is connected to a power source and a circuit component, it is unlikely that oil and/or dirt will migrate through the vent channels 150*a-d* into the cavity 180 so that the fuse element 160 remains free of contaminants.

As described above, the housing 140 may include upper and lower housing parts 140*a*, 140*b* which are assembled to form the fuse 100. As depicted, the upper and lower housing parts 140*a*, 140*b* may each include a cavity 180*a*, 180*b*. The cavities 180*a*, 180*b* may define a space to receive the fuse element 160. The cavities 180*a*, 180*b* may be hollow spaces in the upper and lower housing parts 140*a*, 140*b*.

In embodiments, as shown in FIG. 2A, at least one of the upper and lower housing parts 140*a*, 140*b* may include respective walls, or protrusions 195 that extend into the cavity 180 and support the fuse element 160. The protrusions 195 may be configured to be on one side of the cavity 180, e.g., in cavity 180*b*. In embodiments, the protrusions 195 may extend from both the upper and lower housing parts 140*a*, 140*b* to support and protect different portions of the fuse element 160. As described in detail below, the fuse element 160 may include at least one curvature, so that the protrusions 195 may be configured to extend between the curvature and underneath the fuse element 160 to support and align the fuse element 160 within the cavity 180. The protrusions 195 may be made of the same material as the housing 140, and may be configured in any shape to receive and support the fuse element 160.

The clearances 145*a*, 145*b* may be configured to allow the terminals 110, 115 to pass through the housing 140 when the housing 140 is assembled. That is, when the upper housing part 140*a* is assembled with the lower housing part 140*b*, the clearances 145*a*, 145*b* may allow the terminals 110, 115 to extend outside of the housing 140 to facilitate electrical connection of the fuse 100 to a power source and circuit component.

The terminals 110, 115 may additionally have alignment holes 165*a-d*. The alignment holes 165*a-d* may be configured to align with alignment portions 170*a*"-d" of the housing 140*b* when the fuse 100 is assembled. For example, the alignment portions 170*a*"-d" on lower housing part 140*b* are configured to align with respective receiving alignment portions 170*a*'-d' on housing 140*a*. The complementary alignment portions 170*a*'-d' and 170*a*"-d" may be configured to snap together, and/or provide space for an adhesive (e.g., epoxy or the like) to secure the housing 140 once assembled. In embodiments, the alignment portions 170*a*'-d' and 170*a*"-d" may be posts and holes, respectively, so that the posts fit into the holes to secure the upper and lower housing 140*a*, 140*b*. Although FIG. 2 shows alignment portions 170*a*"-d" as protrusions on the lower housing part 140*b*, the alignment portions 170*a*'-d' and 170*a*"-d" may be any combination of protrusions and receiving holes on each housing part 140*a*, 140*b*. The alignment portions 170*a*'-d' and 170*a*"-d" may be circular, rectangular, or polygonal shaped protrusions and corresponding slots or receiving holes. The alignment holes 165*a-d* and alignment portions 170*a*'-d' can then retain the housing 140 over the fuse element 160 when the fuse 100 is assembled.

The housing 140 may further include alignment blocks 175*a*"-d" and receiving portions 175*a*'-d'. The alignment blocks 175*a*"-d" provide precise alignment between the upper and lower housing parts 140*a*, 140*b*, so that when the housing 140 is assembled, for example, by ultrasonic welding, the housing 140 is tightly connected to provide a sealed fuse. The alignment of the terminals 110, 115 and fuse element 160 within the housing 140 by alignment portions 170*a*'-d' and 170*a*"-d" ensures that the fuse element 160 is properly positioned within the cavity 180 so that arcing can occur in response to an overcurrent event. Precise alignment of the fuse components provides for a better seal of the housing 140 when assembled around the fuse element 160. A properly assembled fuse provides higher reliability for users in that the fuse will protect circuit components in the event of an overcurrent condition. Attaching the housing components together over the relatively large area provided by the alignment blocks also gives greater mechanical strength than a design which relies on pins alone.

Figure 3A:
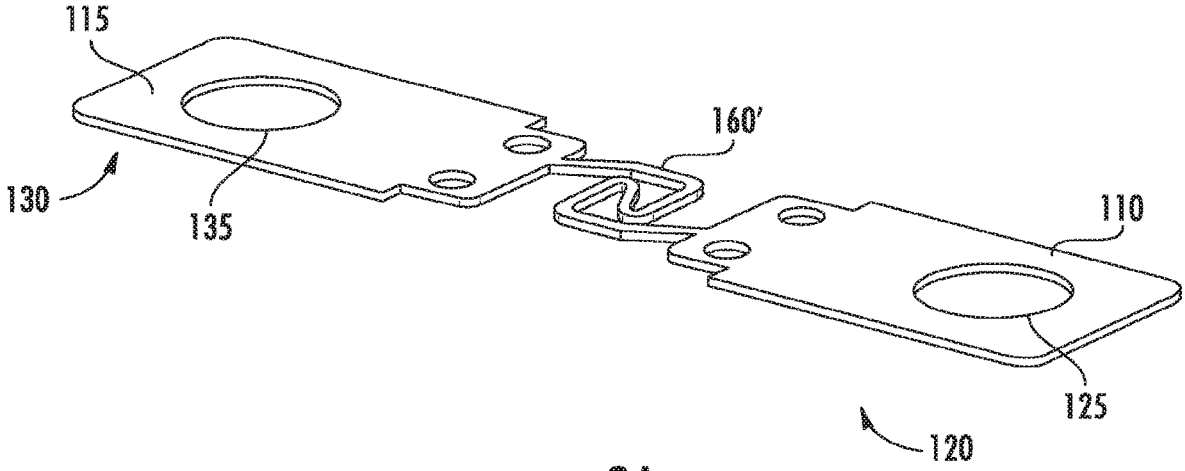
FIGS. 3A-3B are perspective views illustrating exemplary fuse elements according to alternative embodiments of the present disclosure.
Figure 3B:
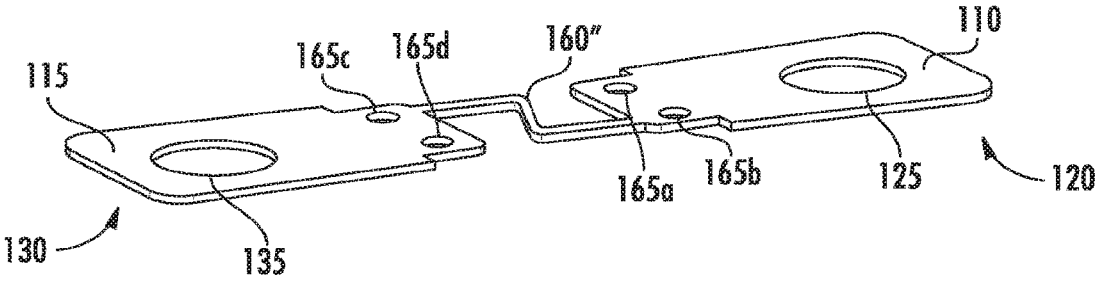

As described above, the fuse element 160 may include at least one curvature. The fuse element 160 may be formed in any shape that can be housed within the cavity 180 of the housing 140. FIGS. 3A and 3B illustrate various embodiments of the fuse element 160. For example, the fuse element 160' shown in FIG. 3A includes multiple bends and curvatures. The fuse element 160' is disposed between the terminals 110, 115, and when assembled into the fuse 100, the fuse element 160' is contained within the housing 140 (FIGS. 1 and 2). Referring to FIG. 3B, the fuse element 160" includes a Z-shape form. It will be appreciated that the shape of any of the fuse elements 160, 160', 160" can be varied to suit a desired application so that during arcing, the fuse element 160, 160', 160" quickly vaporizes and isolates protected circuit components to prevent or mitigate damage to such components.

Figure 4A:
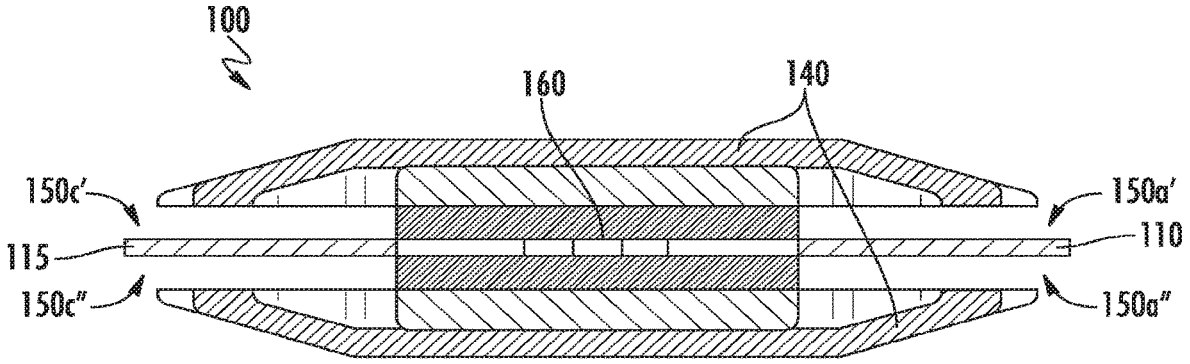
FIGS. 4A-4B are cut-away views illustrating an example of a fuse before and after the fuse element melts according to embodiments of the present disclosure.
Figure 4B:
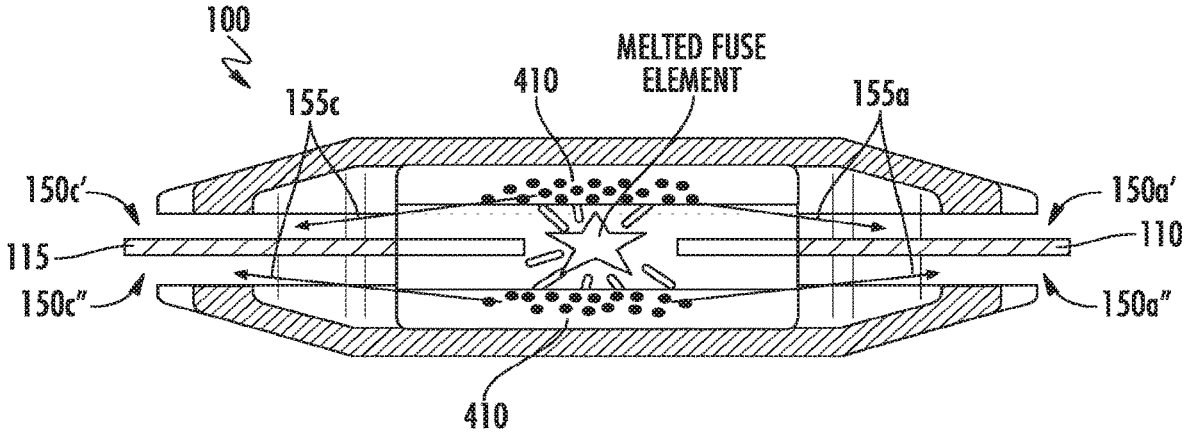

FIGS. 4A, 4B illustrate a cut-away view of fuse 100 before and after the fuse element melts. In particular, FIG. 4A illustrates the fuse 100 before the fuse element 160 has melted while FIG. 4B illustrates the fuse 100 including the melted fuse element 160. Terminals 110, 115 extend out from the housing 140 and provide a path for current to flow through the fuse element 160. The fuse element is positioned within the cavity 180 of the housing.

When an overcurrent and/or overvoltage condition occurs, the fuse element 160 melts and vaporizes as described above. The vaporized material 410 is expelled from the housing 140 via vent channels 150*a-d* in the direction of arrows 155*a-d* to relieve internal pressure of the cavity 180.

Figure 5:
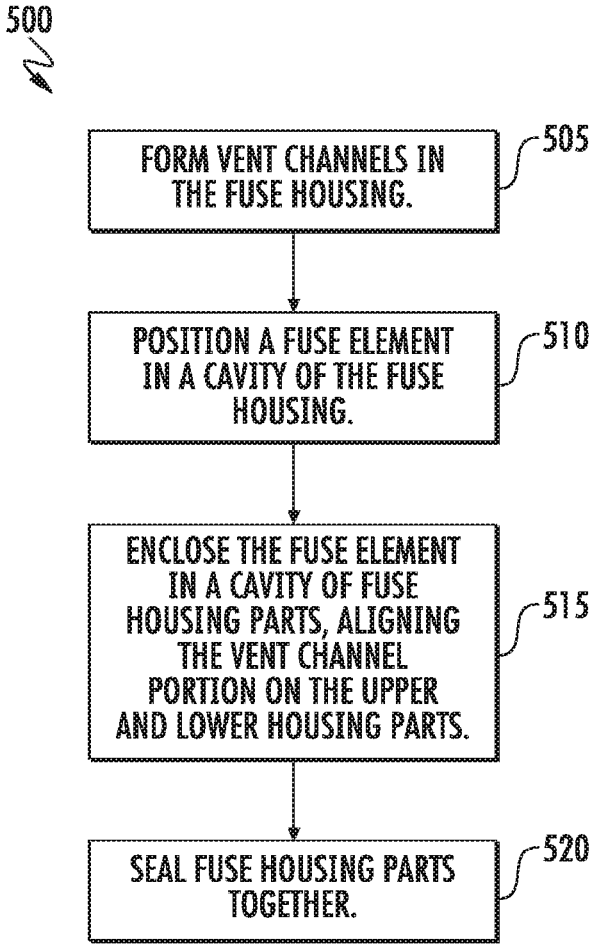
FIG. 5 is a flow diagram illustrating a method of manufacturing a fuse according to the present disclosure.

Referring to FIG. 5, an exemplary method 500 for forming a fuse according to the present disclosure is shown. The exemplary method will now be described in detail in conjunction with the representations of the fuse 100 shown in FIGS. 1 and 2.

At step 505 one or more vent channels are formed in a fuse housing. A portion of the vent channel may be formed in each of the upper housing part and a lower housing part, so that when the housing is assembled, the vent channel portions are aligned. The vent channels are formed from an outer surface of the fuse housing to the internal cavity of the fuse housing, such that vaporized material and air can escape the cavity to reduce internal pressures during arcing in an overcurrent event. Vent channels may be formed on all sides of the fuse housing, so that the vaporized material may escape out in each direction. Vent channels may be formed only opposite sides of the housing, so that vaporized material is vented in specified directions.

At step 510 a fuse element is disposed between terminals and positioned in the cavity of the fuse housing. At step 515, the upper housing part and the lower housing part are aligned enclosing the fuse element. As described above, the housing parts can include alignment protrusions such as posts and blocks, and corresponding receiving apertures. Step 515 may include aligning these features so that the housing parts are precisely aligned together and relative to the alignment holes in the terminals. Proper alignment ensures the fuse element is properly positioned in the cavity of the housing, as well as the vent channel portions, so that vaporized material from the fuse element may escape from the cavity via the vent channels.

At step 520, the housing parts are sealed together to form the housing. In embodiments, the housing is sealed around all the edges. In embodiments, the housing is sealed via ultrasonic welding. This ensures the housing parts are securely joined together and providing a tight seal. As described above in step 505, a vent channel portion may be disposed on an upper housing part, and a vent channel portion may be disposed on a lower housing part. When the upper and lower housing parts are joined together, the vent channel portions are aligned. During operation, arcing of the fuse element occurs in an overcurrent condition, such that a high amount of energy and material is released. The ultrasonic welding of the fuse housing provides for a strong seal, such that internal pressures build in the cavity of the housing. The vent channels allow the vaporized material to escape the fuse housing, so that internal pressures are relieved.

As used herein, references to "an embodiment," "an implementation," "an example," and/or equivalents is not intended to be interpreted as excluding the existence of additional embodiments also incorporating the recited features.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize its usefulness is not limited thereto and the present disclosure can be beneficially implemented in any number of environments for any number of purposes. Thus, the claims set forth below are to be construed in view of the full breadth and spirit of the present disclosure as described herein.

What is claimed is:

1. A method of forming a fuse, comprising:

joining a first housing part to a second housing part to form a housing that defines a cavity;

disposing a fuse element within the cavity with a first terminal extending from a first end of the fuse element and out of the housing and a second terminal extending from a second end of the fuse element and out of the housing, the fuse element comprising a curvature;

providing a pair of protrusions within the first housing part and the second housing part, wherein the pair of protrusions extend between the curvature and underneath the fuse element to support and align the fuse element within the cavity; and providing the housing with a vent channel extending from an outer surface of the housing to the cavity for allowing vapor to escape from the cavity, the vent channel further comprising:

a first pair of vent channels disposed on opposing sides of the housing;

a second pair of vent channels disposed on second opposing sides of the housing, wherein the first pair of vent channels is orthogonal to the second pair of vent channels; and a wall portion disposed at the outer surface of the housing, the wall portion being thick enough to be molded into the housing but thin enough to rupture during an overload or short circuit condition, the wall portion for preventing ingress of external contaminants into the cavity.

2. The method of claim 1, wherein joining the first housing part to the second housing part includes mating an alignment portion of the first housing part with an alignment portion of the second housing part to align the first housing part with the second housing part in a desired manner.

3. The method of claim 1, wherein the first housing part and the second housing part are joined via ultrasonic welding.

4. The method of claim 1, further comprising an outer barrier attachable to the outer surface of the housing and configured to cover the vent channel for preventing ingress of external contaminants into the cavity.

5. The method of claim 1, wherein the vent channel defines a non-linear path between the outer surface of the housing and the cavity for mitigating ingress of external contaminants into the cavity.

6. The method of claim 1, wherein the first pair of vent channels is bisected by either terminal.

* * * * *